US005713570A

United States Patent [19]

Ouchi

[11] Patent Number: 5,713,570

[45] Date of Patent: Feb. 3, 1998

[54] PAPER SUPPLY CASSETTE AND PAPER SUPPLY DEVICE HAVING PAPER SUPPLY CASSETTE

[75] Inventor: Toshiaki Ouchi, Yokohama, Japan

[73] Assignee: Kabushiki Kaisha Toshiba, Kawasaki, Japan

[21] Appl. No.: 560,587

[22] Filed: Nov. 20, 1995

[30] Foreign Application Priority Data

Nov. 21, 1994 [JP] Japan ..... 6-286523

[51] Int. Cl.[6] ..... B65H 9/04

[52] U.S. Cl. ..... 271/242; 271/171

[58] Field of Search ..... 271/171, 145; 221/242

[56] References Cited

FOREIGN PATENT DOCUMENTS 54-9342 5/1979 Japan .
1285533 11/1989 Japan ..... 271/171
2-75431 6/1990 Japan .
47217 1/1992 Japan ..... 271/171

*Primary Examiner*—David H. Bollinger
*Attorney, Agent, or Firm*—Foley & Lardner

[57] ABSTRACT

The paper supply device of the present invention comprises a paper containing section for containing paper, a pickup roller for picking up paper contained in the paper containing section, a base movably provided in said paper containing section in a direction perpendicular to a direction where the paper is picked up, a lever, provided on the base, for locking the base to a predetermined position, and a guide body, provided on the base, placed at a first position separating from the base to resist against urging force of a tension spring when the guide body is urged to a direction close to the base by the tension spring and the the locking of the base by the lever is released, and placed at a second position separating from a side surface portion of the paper by urging force of the tension spring and being close to the base to guide the paper when the base is locked by the lever after contacting the side surface portion of the paper by movement of the base.

6 Claims, 7 Drawing Sheets

PAPER SUPPLY CASSETTE AND PAPER SUPPLY DEVICE HAVING PAPER SUPPLY CASSETTE

BACKGROUND OF THE INVENTION

1. Field of the Invention

The present invention relates to a paper cassette for supplying paper to an electric copy machine and a paper supply device having the paper supply cassette.

2. Description of the Related Art

Conventionally, an electric copying machine comprises a paper supply cassette. Then, paper is picked up from the paper supply cassette by a pickup rollers. The paper is fed to an image transferring section provided between a photosensitive drum and a transferring charger, so that an image is transferred thereto.

The paper supply cassette comprises a pair of slidable guide bodies in its inside. The pair of guide bodies is moved in accordance with the size of paper and contacts both side portions of paper, so that paper is guided in a paper pickup direction.

If friction between the guide bodies and side surface portion of paper is large, paper cannot smoothly picked up.

In order to solve this problem, surface processing is provided to the guide surface of the guide bodies to give luster thereto, so that friction can be reduced, and paper can be smoothly picked up.

However, there is a disadvantage in the point that the manufacturing cost is increased if the surface processing is provided to the guide surface of the guide body.

In order to solve the above point, the weight of the pickup rollers are increased to enhance frictional force between the pickup rollers and paper.

However, the pickup rollers are structured to be lifted upward by a spring member such that the pickup rollers are not caught by he paper supply cassette at the time of drawing the paper supply cassette. Due to this, if the weight of the pickup rollers is increased, spring force of the spring member must be considerably increased since the pickup rollers are lifted upward. Due to this, there is a problem in difficulty of setting spring force.

In order to solve this problem, a predetermined space (about 0.5 mm) is formed between the guide body and both side surfaces of paper so as to reduce friction between paper and the pickup rollers.

However, in conventional, since the positioning of the guide body was set by a user, the confirmation of the space between the guide body and the side surfaces of paper differed from person to person.

Due to this, there occurs the problem in which the above space is too large or too small. In the case of too large space, paper was skewed. In the case of too small space, the paper jam or paper supply defect occurs.

SUMMARY OF THE INVENTION

The present invention has been made in consideration of the above-mentioned problems, and an object of the present invention is to provide a paper supply cassette forming a suitable space between paper and a guide body without depending on a user's sense, thereby guiding paper smoothly, and a paper supply device having the paper supply cassette.

According to the present invention, there is provided a paper supply cassette comprising: a paper containing section for containing paper; a moving member movably provided in the paper containing section; and means for guiding a side surface portion of the paper, wherein the guiding means is provided in the moving member and placed at a first position separating from the moving member to come in contact with the side surface portion of the paper when the moving member is moved, and placed at a second position separating from the side surface portion of the paper and being close to the moving member, when the moving member is fixed.

According to the above-mentioned structure, a space having a predetermined size can be automatically set between the guide body and paper, and paper can be smoothly guided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The following will explain a first embodiment of the present invention with reference to FIGS. 1 to 13.

Figure 1:
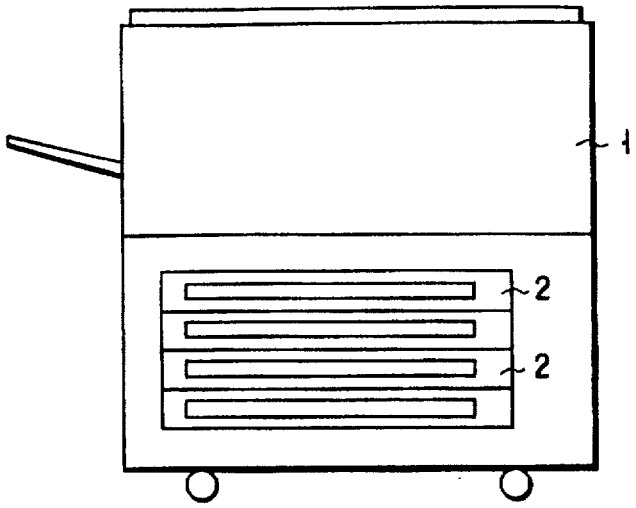
FIG. 1 is a front view showing an electric copying machine of a first embodiment of the present invention.

FIG. 1 shows an electronic copying apparatus.

In FIG. 1, reference numeral 1 is a main body of the apparatus. Paper supply cassettes 2 . . . of a plurality of steps are movably provided in a lower side portion of the apparatus 1.

Figure 2:
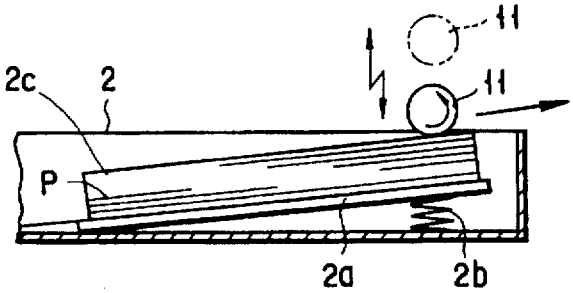
FIG. 2 is a cross sectional view showing a paper supply cassette.

FIG. 2 shows the paper supply cassette 2.

In a paper containing section 2c of the paper supply cassette 2, paper P is contained in a stack form. Paper P is mounted on a tray 2a. The tray 2a is urged upward by a spring 2b, and paper P is pressed by pickup rollers 11, serving as picking-up means, which are provided to be movable up and down in the main body 1.

By the rotation of the pickup rollers 11, paper P is picked up one by one from the paper supply cassette 2 to be supplied. Paper P is delivered to an image transferring section by a delivering mechanism (not shown) so that an image is transferred thereto.

Figure 3:
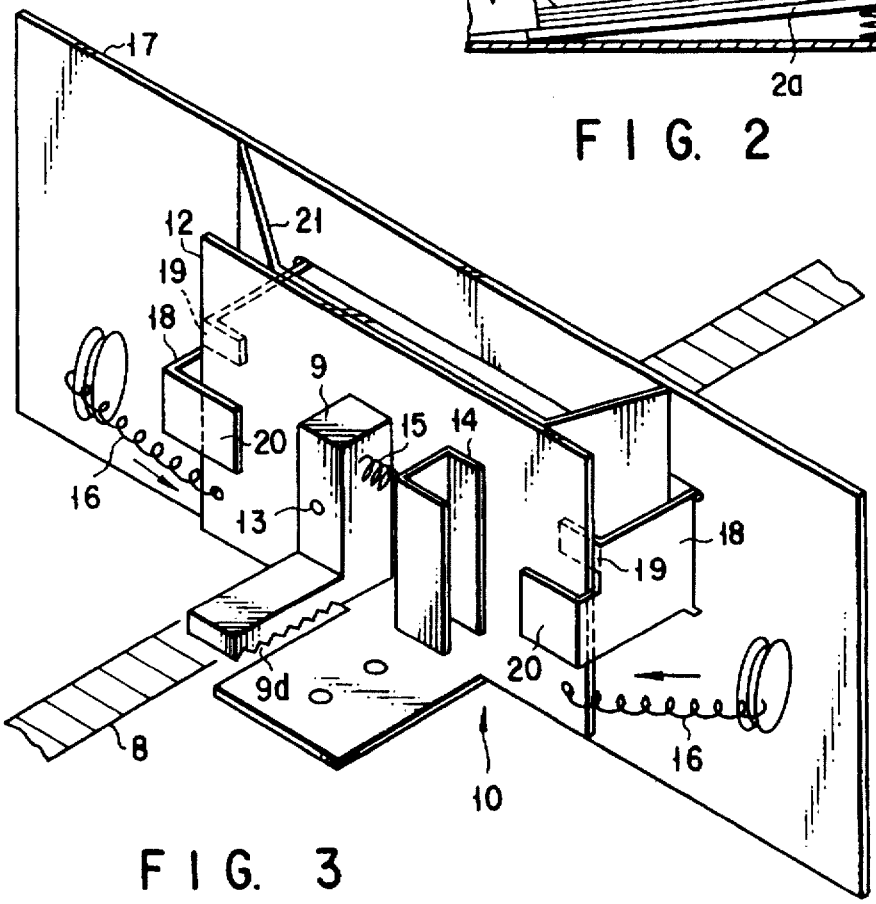
FIG. 3 is a perspective view showing a paper guide mechanism.
Figure 4:
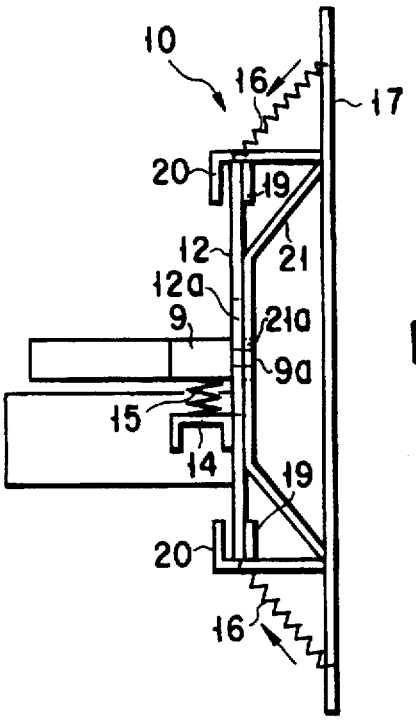
FIG. 4 is a plan view of the paper guide mechanism.

FIGS. 3 and 4 show only one side of guide mechanisms 10 of paper P. The guide mechanisms 10 are provided at both sides of the paper cassette 2.

Each guide mechanism 10 has a base 12 serving as a moving member. A lever 9, which is L-shaped to serve as locking means freely rotating through a shaft 13, is formed on the base 12. Continuous convex and concave portions 9d are formed in a bottom surface of the lever 9. The convex and concave portions 9d are detachably engaged with a rail 8, which is formed to have continuous convex and concave portions in an inner bottom portion of the paper supply cassette 2. The convex and concave portion 9a lock the base 12. A knob 14 is provided on the base 12 to be opposite to the lever 9 with space. A spring 15 is provided between the knob 14 and the lever 9. A guide body 17 is provided through tension springs 16, 16, serving as urging members. The guide body 17 is urged in an arrow direction, that is, a direction close to the base 12.

A pair of cut pieces 18, 18 are formed in the guide body 17. First and second stoppers 19 and 20 are bent to be formed on a top end portion of each of the cut portions. The base 12 is inserted between these first and second stoppers 19 and 20 with a predetermined space. A plate spring 21, which has bent and serves as a pressing member, is provided in a space section formed of the guide body 17, the cut pieces 18, 18, and the base 12.

Figure 5:
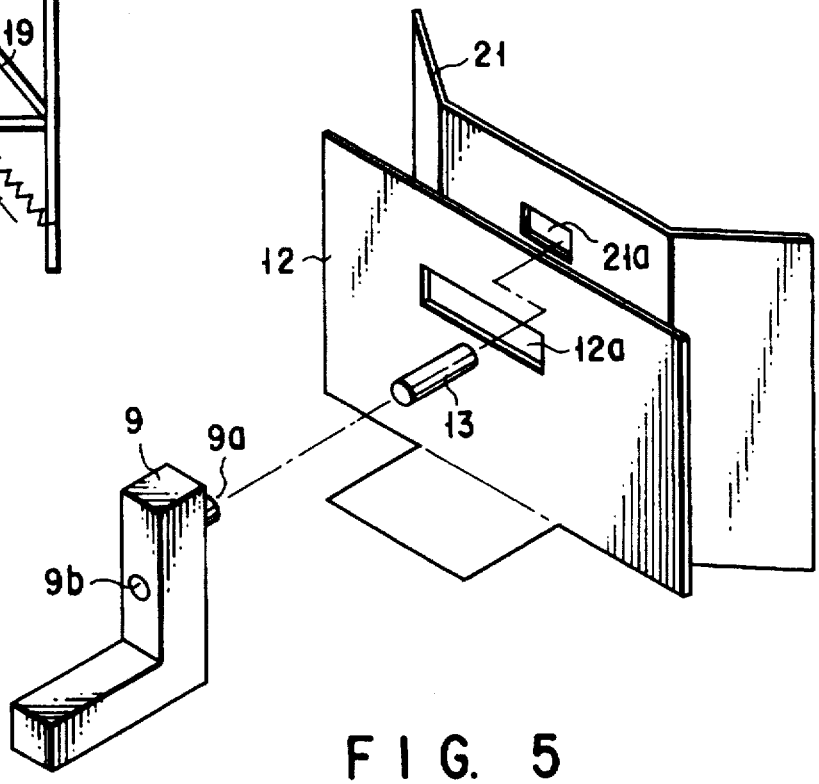
FIG. 5 is a perspective exploded view showing the paper guide mechanism.

FIG. 5 is an exploded view showing the lever 9, the base 12, and the plate spring 21. A projection 9a is formed on the upper portion of the back surface of the lever 9, and an insertion hole 9b to which the shaft 13 is inserted is formed at substantially a central portion. Opening 12a and 21a communicating with each other are formed in the base 12 and the plate spring 21, respectively. The projection 9a of the lever 9 is inserted to these openings 12a and 21a.

Figure 6:
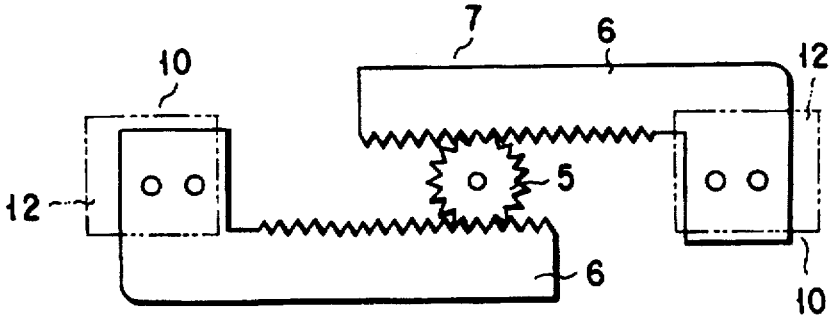
FIG. 6 is a plan view showing an interlocking mechanism of the paper guide mechanisms.

FIG. 6 shows an interlocking mechanism 7 for interlocking the guide mechanisms 10, 10, which are provided at both sides of the paper supply cassette 2.

The interlocking mechanism 7 comprises a rack 5 and pinions 6, 6 to simultaneously move the guide mechanisms 10, 10 in a direction where the guide mechanisms are made close other other or separated from each other.

Figure 7:
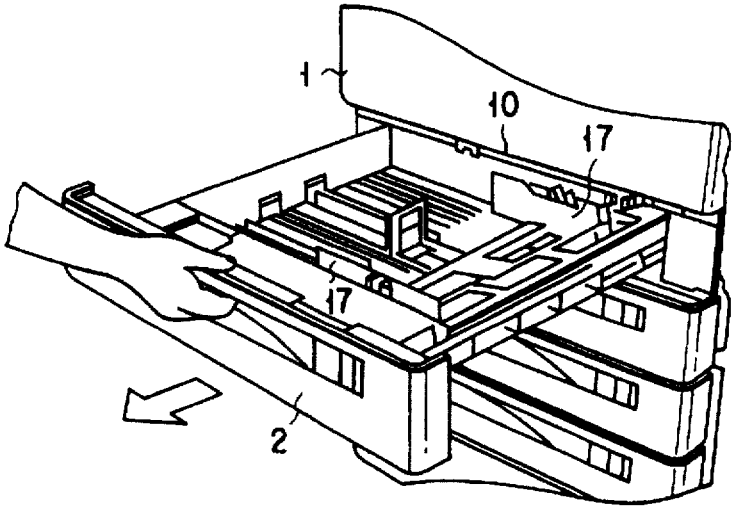
FIG. 7 is a view showing a paper replenishing operation.
Figure 8:
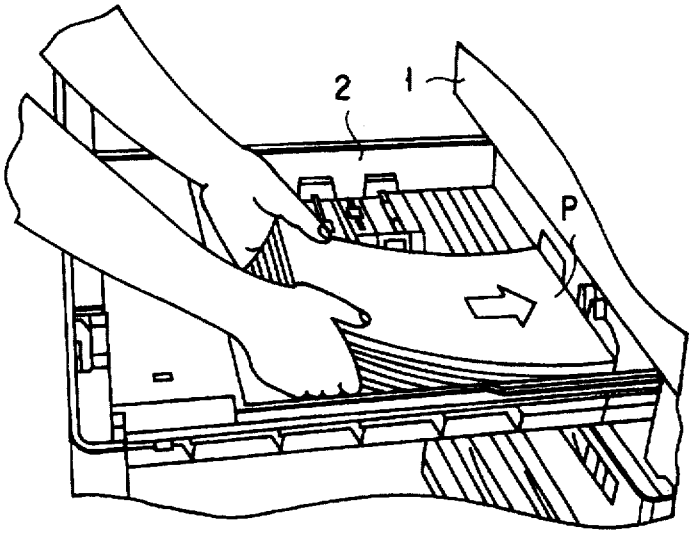
FIG. 8 is a view showing a paper replenishing operation.
Figure 9:
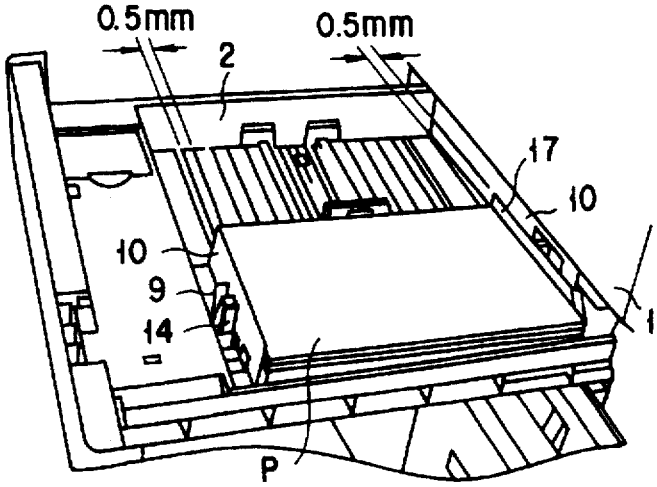
FIG. 9 is a view showing a paper replenishing operation.

FIGS. 7 to 9 are views each show a paper replenishing operation.

First, as shown in FIG. 7, the paper supply cassette 2 is drawn from the main body 1 of the apparatus. Then, as shown in FIG. 8, paper P is replenished into the paper supply cassette 2. Thereafter, as shown in FIG. 9, the guide mechanisms 10, 10 are moved to be along both side portions of paper P, and the paper supply cassette 2 is inserted to the main body 1 of the apparatus.

FIGS. 10 to 13 are views each showing a moving operation of the guide mechanism 10 of FIG. 9.

Figure 10:
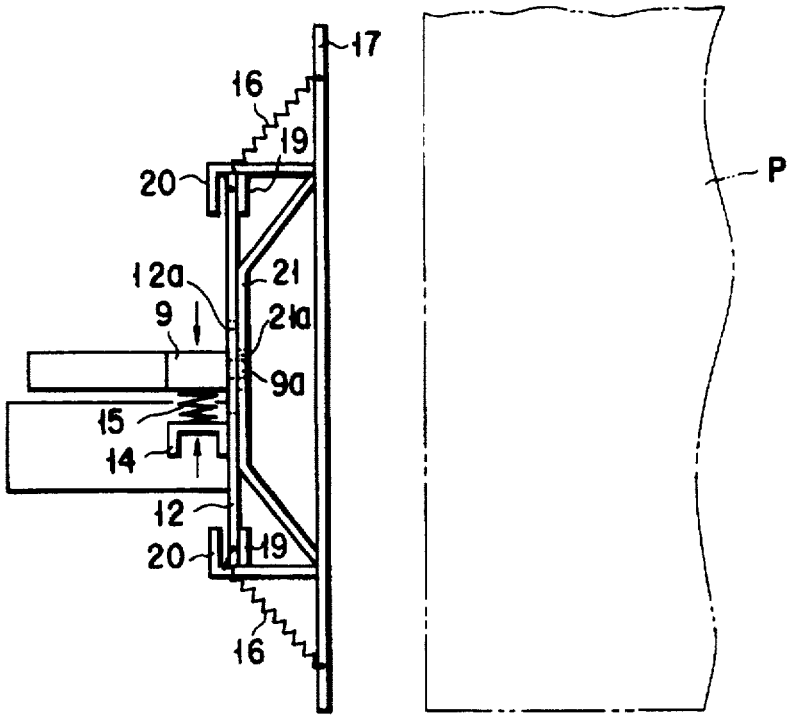
FIG. 10 is a view showing an operation of the guide mechanism.
Figure 11:
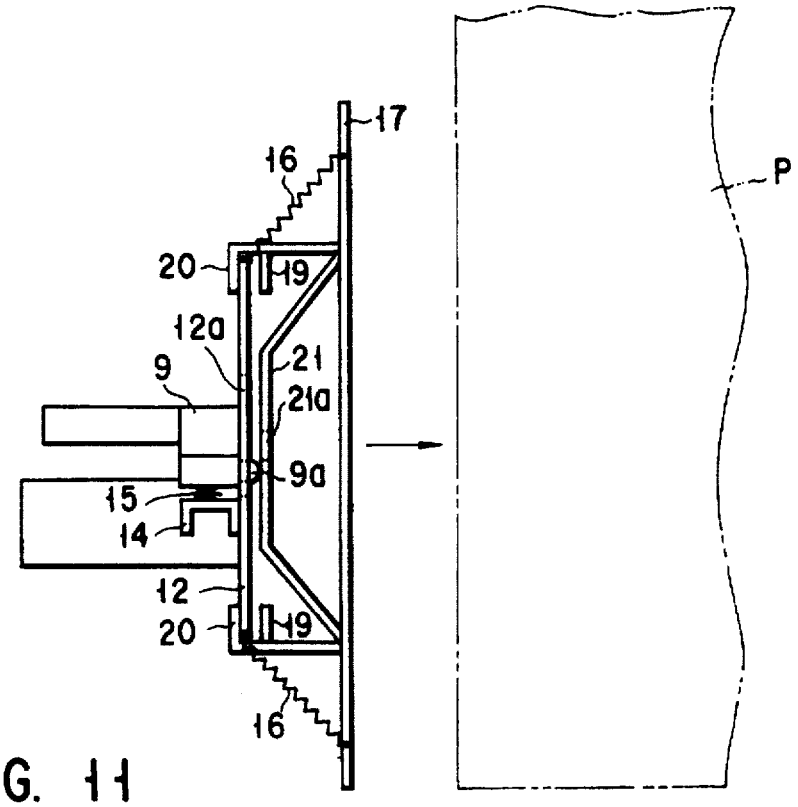
FIG. 11 is a view showing an operation of the guide mechanism.
Figure 12:
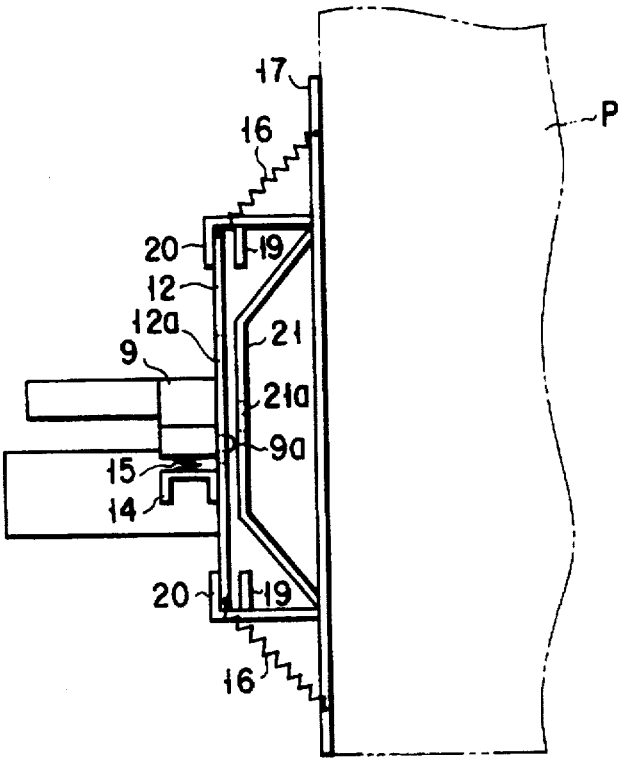
FIG. 12 is a view showing an operation of the guide mechanism.
Figure 13:
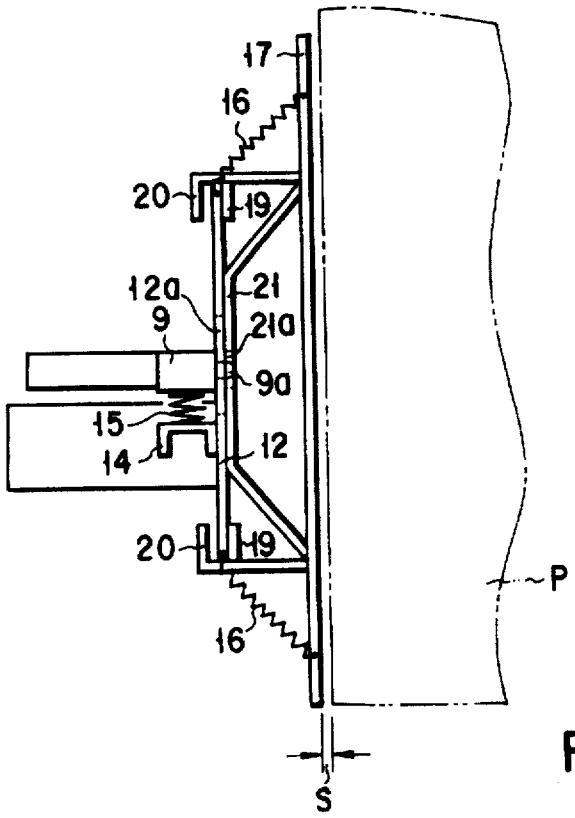
FIG. 13 is a view showing an operation of the guide mechanism.

First of all, as shown in FIG. 10, an operator picks up the knob 14 of the guide mechanism 10 and the lever 9 with his fingers to apply force in an arrow direction. Thereby, the lever 9 resists against force of the spring 15, and is rotated around the shaft 13 as shown in FIG. 11. By the rotation of the lever 9, the concave and convex portions 9d of the lever 9 and the rail 8 are disengaged, so that the base 12 is in a movable state. At this time, the projection 9a of the back surface of the lever 9 is detached from the opening 21a of the plate spring 21, and mounted on the plate surface of the plate spring 21, so that the plate spring 21 is pressurized. The guide body 17 is pressurized by use of the spring property of the plate spring 21. Thereby, the guide body 17 resists against tensile force of the tension springs 16, 16, and is pressurized by a predetermined amount (size of the projection from the plate spring 21 of the projection 9a). Thereby, the guide body 17 is moved in a direction where the guide body 17 is separated from the base 12. The second stoppers 20, 20 of the right and left cut pieces 18, 18 contact the base 12, thereby the above amount of movement is restricted. As mentioned above, in the state that the guide body 17 is pressed out by the predetermined amount of movement from the base 12, the base 12 is moved to the side surface portion of paper P as shown in FIG. 12. Thereby, the guide bodies 17, 17 are brought into contact with both side surfaces of paper P. Thereafter, if the operator's fingers are released from the lever 9 and the fixing knob 14, the lever 9 is rotated by urging force of the spring 15, and returned to an initial position as shown in FIG. 13, and the concave and convex portions 9d are engaged with the rail 8. At this time, the projection 9a of the lever 9 is inserted to the opening 21a of the plate spring 9a to be fixed thereto again. Then, the pressurization of the plate spring 21 is released, and the guide body 17 is returned to the original position by the tension springs 16, 16. Thereby, a space S is formed between the guide body 17 and paper P. The first stoppers 19, 19 of the cut pieces 18, 18 come in contact with the base 12, thereby the amount of return of the guide body 17 is restricted.

As mentioned above, the guide mechanisms 10, 10 are moved and the guide bodies 17, 17 are brought into contact with both slide surface portions of paper P. Thereafter, the guide bodies 17, 17 are automatically and mechanically separated from both side surface portions of paper P by a predetermined size S (about 0.5 mm). Due to this, as compared with the case in which the space is manually formed, the space can be considerably precisely formed.

Therefore, according to the present invention, paper can be smoothly guided and supplied without being skewed and jumped.

Moreover, since the guide body 17 is made close to the base 12 or separated therefrom by the rotational operation of the lever 9, the lock and unlock operation of the base 12 and the close and separate operation of the guide body 17 are can be performed at the same time, and good operability can be obtained.

Figure 14:
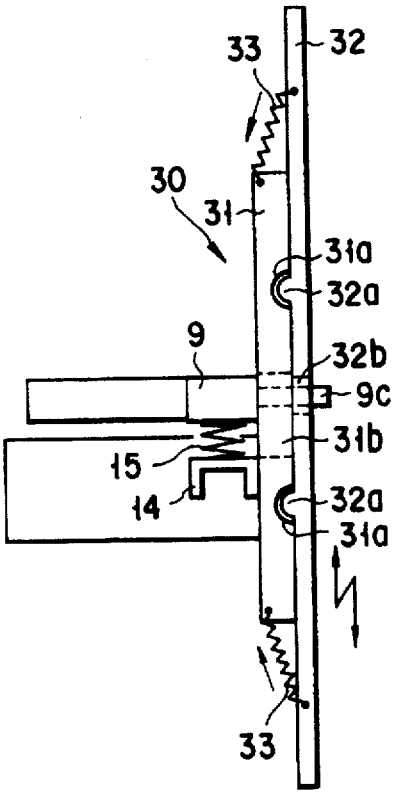
FIG. 14 is a plan view showing a guide mechanism of a second embodiment of the present invention.

FIG. 14 shows a guide mechanism 30 of a second embodiment of the present invention.

In FIG. 14, reference numeral 31 is a base serving as a moving member. The base 31 is slidably formed in a direction perpendicular to a direction where paper P is picked up. The lever 9, the knob 14, and the spring 15, which are the same as shown in the first embodiment, are provided on the one surface of the base 31. Concave portions 31*a*, 31*a* are formed on the other side surface of the base 31. A guide body 32 is slidably attached to the base 31 in a close and separate direction to the base 31. The guide body 32 is urged to the base 31 by springs 33, 33. Projections 32*b*, 32*b*, which are attached and detached to/from the concave portions 31*a*, 31*a* of the base 31, are formed in the guide body 32.

A long hole 31*b* is formed in the base 31, and an insertion hole 32*b* is formed in the guide body 32. These long hole 31*b* and the insertion hole 32*b* are communicated with other. An operation rod 9*c*, which is inserted between the long hole 31*b* and the insertion hole 32*b*, is formed in the lever 9.

If the lever 9 is rotated around the shaft 13, the guide body 32 is slid along the base 31, so that the projections 32*a*, 32*a* are detached from the concave portions 31*a*, 31*a* of the base 312.

FIGS. 15 to 18 are views each showing an operation of the guide mechanism 30.

Figure 16:
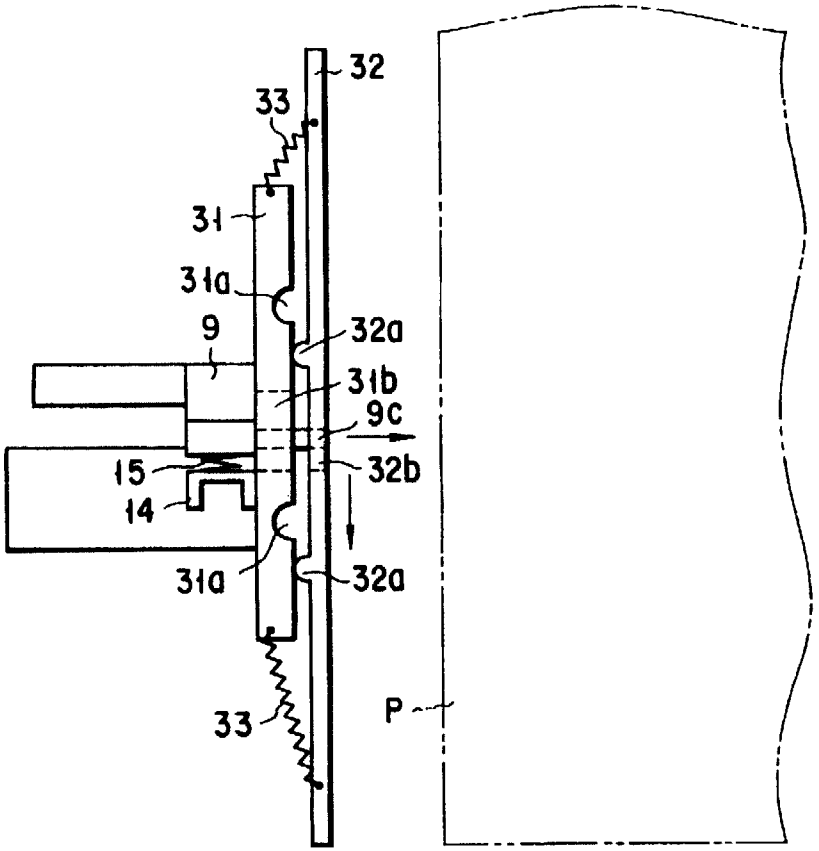
FIG. 16 is a view showing an operation of the guide mechanism.
Figure 15:
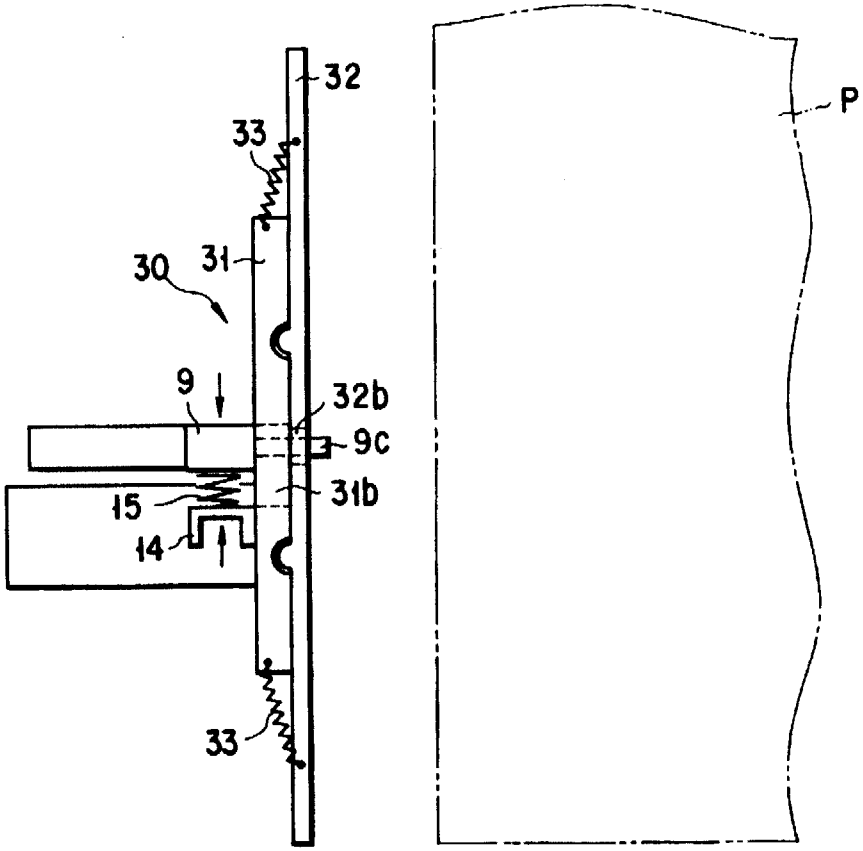
FIG. 15 is a view showing an operation of the guide mechanism.

First of all, as shown in FIG. 15, the operator picks up the knob 14 of the guide mechanism 30 and the lever 9 with his fingers to apply force in an arrow direction. Thereby, the lever 9 resists against force of the spring 15, and is rotated around the shaft 13 as shown in FIG. 16. By the rotation of the lever 9, the concave and convex portions 9*d* of the lever 9 and the rail 8 are disengaged, so that the base 12 is in a movable state. At this time, the guide body 32 resists against tensile force of the tension springs 33, 33, and is slide by a predetermined amount in an arrow direction. Thereby, the projections 32*a*, 32*a* are detached from the concave portions 31*a*, 31*a* of the base 31 and separated from the base 31.

Figure 17:
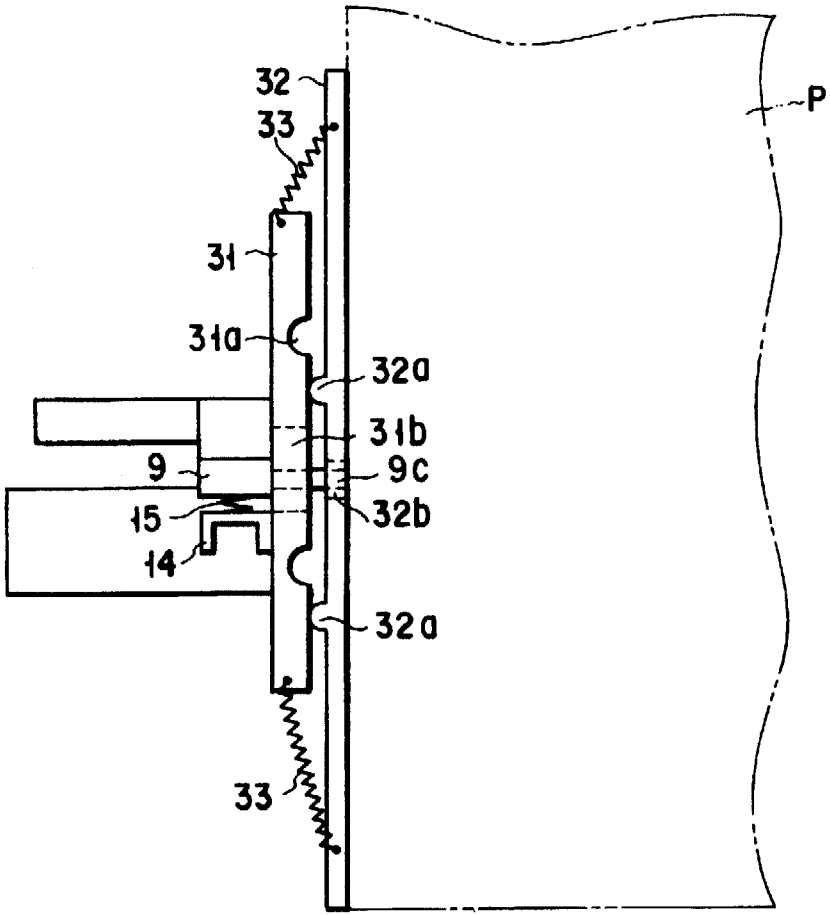
FIG. 17 is a view showing an operation of the guide mechanism.

As mentioned above, in the state that the guide body 32 is pressed out by the predetermined amount of movement from the base 31, the base 31 is moved to the side surface portion of paper P as shown in FIG. 17. Thereby, the guide body 32 is brought into contact with the side surface portion of paper P.

Figure 18:
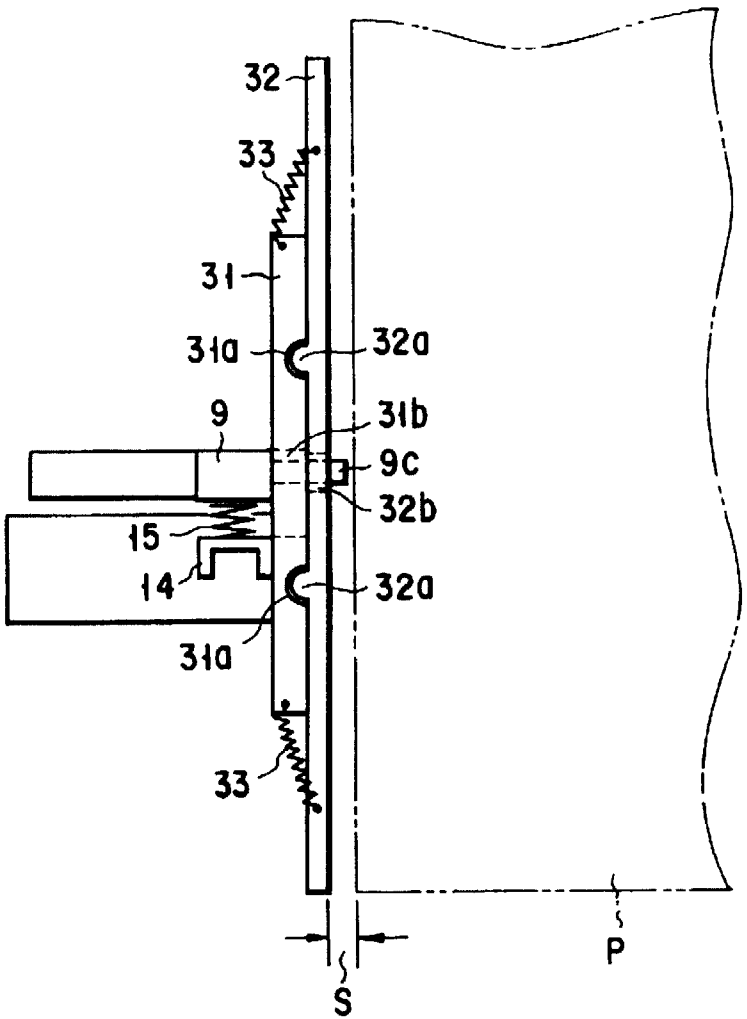
FIG. 18 is a view showing an operation of the guide mechanism.

Thereafter, if the operator's fingers are released from the lever 9 and the fixing knob 14, the lever 9 is rotated by urging force of the spring 15, and returned to an initial position as shown in FIG. 18, and the concave and convex portions 9*a* are engaged with the rail 8. Thereby, the guide body 32 is returned to the original position by the tension springs 33, 33. Thereby, the projections 32*a*, 32*a* are engaged with the concave portions 31*a*, 31*a* to be brought into contact with the base 31. Moreover, the guide body 32 is separated from the side surface portion of the paper P, thereby a space S is formed to guide paper P.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A paper supply cassette comprising:

a paper containing section for containing paper;

a moving member movably provided in said paper containing section which can be moved to a position corresponding to a size of the paper contained in said paper containing section; and guiding means, supported by said moving member and movable between said moving member and a side surface of the paper, said guiding means having a first position and a second position, the second position being closer to the moving member than the first position, the guiding means guiding the side surface of said paper;

wherein said guiding means is placed at the first position when said moving member is moved, and placed at the second position when said moving member is fixed.

2. A paper supply cassette according to claim 1, further comprising:

locking means, provided on said moving member, for locking said moving member to a predetermined position;

wherein said guiding means is placed at said first position when said moving member is unlocked by said locking means, and placed at said second position when said moving member is locked by said locking means.

3. A paper supply cassette comprising:

a paper containing section for containing paper to be picked up, the paper being picked up in a pick-up direction;

a moving member, having a first opening, movably provided in said paper containing section to move in a direction perpendicular to said pick-up direction;

a guide body, supported by said moving member, for guiding a side surface of said paper along said pickup direction;

an urging member for urging said guide body toward said moving member;

a pressing member, provided between said guide body and said moving member and having a second opening opposite said first opening;

operating means, provided in said moving member and having a projecting portion releasibly inserted into said second opening for moving said guide body to a first position wherein said guide body is separated from said moving member against an urging force of said urging member by detaching said projecting portion from said second opening to relocate said pressing member when said moving member is moved toward said paper;

said operating means further being for moving said guide body to a second position wherein said guide body is separated from the side surface of said paper by the urging force of said urging member by inserting said projecting portion to said second opening after said guide body contacts the side surface of said paper by the movement of the moving member; and locking means, provided in said operating means, for unlocking said moving member when said guide member is moved to the first position by said operating means, and for locking said moving member when said guide member is moved to said second position.

4. A paper supply device comprising:

a paper containing section for containing paper to be picked up, the paper being picked up in a pick-up direction;

pickup means for picking up paper contained in said paper containing section;

a moving member movably provided in said paper containing section, and being movable in a direction perpendicular to said pick-up direction; and a guide body for guiding a side surface of said paper, said guide body being supported by said moving member and having a first position and a second position, the second position being closer to the moving member than the first position;

wherein said guide body is placed at the first position when said moving member is moved, and placed at the second position when said moving member is fixed.

5. A paper supply device according to claim 4, further comprising:

locking means, provided in said moving member, for locking said moving member to a predetermined position;

wherein said guide body is placed at said first position when said moving member is unlocked by said locking means, and placed at said second position when said moving member is locked by said locking means.

6. A paper supply device:

a paper containing section for containing paper to be picked up, the paper being picked up in a pick-up direction;

pickup means for picking up the paper contained in said paper containing section;

a moving member, having a first opening, movably provided in said paper containing section to move in a direction perpendicular to the pick-up direction;

a guide body, supported by said moving member, for guiding a side surface of said paper along the pick-up direction;

an urging member for urging said guide body toward said moving member;

a pressing member, provided between said guide body and said moving member, and having a second opening opposite said first opening;

operating means, provided in said moving member and having a projecting portion releasibly inserted into said second opening for moving said guide body to a first position where said guide body is separated from said moving member against an urging force of said urging member by releasing said projecting portion from said second opening to relocate said pressing member when said moving member is moved toward said paper; and for moving said guide body to a second position where said guide body is separated from the side surface of said paper by said urging force of said urging member by inserting said projecting portion to said second opening after said guide body contacts the side surface of said paper; and locking means, provided in said operating means, for unlocking said moving member when said guide body is moved to the first position, and for locking said moving member when said guide body is moved to said second position.

* * * * *